United States Patent [19]

Müller et al.

[11] Patent Number: 4,579,695

[45] Date of Patent: Apr. 1, 1986

[54] PROCESS FOR THE PRODUCTION OF A CAST EXPLOSIVE CHARGE FIXEDLY ADHERENT TO A CHARGE CARRIER

[75] Inventors: Otmar Müller, Nohfelden; Günter Berg, Nonnweiler; Werner Scherer, Schweich, all of Fed. Rep. of Germany

[73] Assignee: Diehl GmbH & Co., Nuremberg, Fed. Rep. of Germany

[21] Appl. No.: 734,397

[22] Filed: May 15, 1985

[30] Foreign Application Priority Data

Jun. 1, 1984 [DE] Fed. Rep. of Germany ..... 3420543

[51] Int. Cl.[4] ..... C06B 21/00

[52] U.S. Cl. ..... 264/3 E; 264/3 R; 149/19.5; 149/19.6; 149/19.91

[58] Field of Search ..... 264/3 R, 3 E; 149/19.5, 149/19.6, 19.91

[56] References Cited

U.S. PATENT DOCUMENTS

| | | | |
|---|---|---|---|
| 3,507,114 | 4/1970 | Webb | 264/3 R |
| 3,830,672 | 8/1974 | Lista | 149/19.91 X |
| 4,021,514 | 5/1977 | Daume | 264/3 E |

FOREIGN PATENT DOCUMENTS

| | | | |
|---|---|---|---|
| 2031677 | 2/1969 | France | 264/3 E |

*Primary Examiner*—Peter A. Nelson

*Attorney, Agent, or Firm*—Scully, Scott, Murphy & Presser

[57] ABSTRACT

A process for the production of a cast explosive charge which is fixedly adherent to a charge carrier, such as projectile casings, housings for explosives, warheads, mines, and the like, wherein a liquid explosive is applied onto the preheated charge carrier which is provided with a coating applied as a suspension, and the charge carrier is thereafter cooled down through regulating of the temperature. The suspension is applied on the charge carrier which has been brought to approximately room temperature, to a coating thickness of between about 10 μm and 100 μm, the suspension being essentially constituted of 14 to 46% by weight of a binding resin which is non-hardening in oxygen and having a softing point below the melting point of the explosive; 6 to 26% by weight of a pigment composition; and 24 to 66% by weight of a polymeric solvent composition.

5 Claims, No Drawings

PROCESS FOR THE PRODUCTION OF A CAST EXPLOSIVE CHARGE FIXEDLY ADHERENT TO A CHARGE CARRIER

BACKGROUND OF THE INVENTION

1. Field of the Invention

The present invention relates to a process for the production of a cast explosive charge which is fixedly adherent to a charge carrier, such as projectile casings, housings for explosives, warheads, mines, and the like, wherein a liquid explosive is applied onto the preheated charge carrier which is provided with a coating, and the charge carrier is thereafter cooled down through regulating of the temperature.

2. Discussion of the Prior Art

During the filling of large underwater explosive or blasting charges, as described in German Patent 21 55 229, it is known to apply a uniformly thick bituminous coating onto the inner wall of a charge container. The coating thickness of about 0.2 to 5 mm has the task of dampening impacts which are transmitted to the container and to ensure the safety of the underwater explosive charge during transportation. During the filling of charge carriers, such as the filling of projectile casings with cast explosives, there are utilized relatively complex procedures in order to prevent the formation of a bottom or base gap and a generally low adhesion of the explosive to the inner wall. However, this cannot be attained with the necessary assurance. However, a fixed seating of the filling constituted of the explosive must be afforded under all circumstances in order to prevent any bursting of the weapon barrel caused by shock or impact detonation of the explosive encountered during firing.

SUMMARY OF THE INVENTION

Accordingly, it is an object of the present invention to provide a process for the bonding of surfaces in ammunition containing explosive charges through the utilization of an adhesive medium, in which there is assured the fixed seating of the explosive charge within the charge carrier while avoiding the formation of the above-mentioned bottom or base gap.

The foregoing object is achieved through the application of a process of the type as described hereinabove in which a suspension is applied on the charge carrier which has been brought to approximately room temperature, to a coating thickness of between about 10 μm and 100 μm, the suspension being essentially constituted of:

(a) 14 to 46% by weight of a binding resin which is non-hardening in oxygen and having a softing point below the melting point of the explosive;

(b) 6 to 26% by weight of a pigment composition; and (c) 24 to 66% by weight of a polymeric solvent composition generally constituted of:

30% PVC interpolymerisate,
3% oil-free polyester,
30% xylol,
7% epoxy-modified triglyceride,
0.5% bentone,
1.5% carbon black,
5% ethyl glycol,
13% talcum,
5% butyl acetate,
5% white spirits;

drying the suspension; heating the coated charge carrier to a surface temperature of between about 20° and 90° C.; and filling in the liquid explosive at a temperature of between the solidification point and 110° C.

When the charge carrier is generally cup-shaped, the suspension is applied to the inner circumferential wall of the carrier to form a coating the thickness of which increases from the filling side towards the bottom of the cup-shaped charge carrier from a coating thickness of about 25 μm increasing proportionally with the length of the charge carrier to a maximum of about 80 μm.

Further advantages and features of the inventive process are set forth as described hereinbelow.

Thus, pursuant to the invention there is provided a rational production process with a uniformly constant quality of adhesiveness with the wall. The adhesiveness with the wall is predicated on the explosive which is being filled into the charge carrier dissolves the adhesive medium thereon so that there is achieved an intimate intersticing of the resolidified phases. The adhesive medium itself fixedly adheres to smooth or polished unalloyed metals, as well as to metals which have been pretreated galvanically or cold-phosphated.

DETAILED DESCRIPTION

Rreference may now be had to the following detailed description of the inventive process based on an exemplary representation there pertaining to the filling of a projectile employed as ammunition in barrelled or tube-firing weapons.

A projectile casing is provided on its inner wall with a cold-phosphatically produced protective coating. Applied onto the protective coating, by means of a spraying method, is the adhesive medium at room temperature. After the drying of the adhesive medium, the projectile casing is heated in a water bath until the surface of the adhesive medium reaches a temperature of 70° C. Thereafter, liquid explosive, for example Composition B, is filled into the projectile casing in at a suitable temperature. The subsequently follows the usual cooling phase.

It is important to the invention that there must be precluded any "wet on wet-processing"; in effect, the adhesive medium may only be contacted by the liquid explosive when the adhesive medium not only possesses a solid surface, but is also completely dried out. Only then is there reached the phase of solvating, in effect the solvatation between the adhesive medium and the explosive. The solvating leads to an adhesion to the wall which assuredly avoids the formation of the above-mentioned base gap. At the mechanical removal of the explosive from the projectile casing, there is a complete absence of any spongy locations or shiny lacquered surface areas. The strengths of the adhesive bond between the explosive and the adhesive medium lies above the applicable shear strength of the explosive. Upon the pressing out of an explosive charge from a projectile casing, the matrix of the explosive will rupture close by, however, outside of the solvating zone. Accordingly, there remains intact the coating consisting of the adhesive medium inclusive of a relatively thin and rough layer of explosive which adheres thereto. The fracture zone thus lies completely within the explosive.

For barrelled weapon ammunition it is thus possible to obtain a broader range of utilization, for example, in the field of artillery. In essence, the ammunition withstands considerably high accelerations so that the firing speed is increased through a more rapid positioning and braking of the projectile in the cartridge or projectile chamber, as well as an increase in the firing range of the ammunition through a correspondingly larger number of the charges, without encountering the danger of barrel bursting caused by the charge.

The mechanical load limits are hereby no longer restricted by the adhesiveness of the explosive to the wall of the projectile body, but merely by the strength of the respective explosive.

Through the inventive process there are also eliminated the problems in ammunition which are subject to air loads or forces, such as mines, warheads, and the like. High-frequency vibrations which are encountered during the air transport, and impact loads, such as striking against the ground, no longer lead to a detaching of the explosive charge from the inner wall of the ammunition body.

What is claimed is:

1. In a process for the production of a cast explosive charge which is fixedly adherent to a charge carrier, such as a projectile casing, an explosive housing, warhead, mine and the like, including applying a liquid explosive onto a coated preheated charge carrier; and cooling the charge carrier through a regulated temperature; the improvement comprising: applying said coating as a suspension on said carrier which has been brought to about room temperature, to a coating thickness of between about 10 μm to 100 μm, said suspension being essentially constituted of:

(a) 14 to 46% by weight of a binding resin which is non-hardening in oxygen and having a softing point below the melting point of the explosive;

(b) 6 to 26% by weight of a pigment composition; and (c) 24 to 66% by weight of a polymeric solvent composition generally constituted of:

30% PVC interpolymerisate,
3% oil-free polyester,
30% xylol,
7% epoxy-modified triglyceride,
0.5% bentone,
1.5% carbon black,
5% ethyl glycol,
13% talcum,
5% butyl acetate,
5% white spirits;

drying the suspension; heating coated charge carrier to a surface temperature of between about 20° and 90°; and filling in the liquid explosive at a temperature of between the solidification point and 110° C.

2. A process as claimed in claim 1, wherein the suspension is applied to form a coating thickness of about 50 μm.

3. A process as claimed in claim 2, wherein said charge carrier is generally cup-shaped, comprising applying the suspension to the inner circumferential wall of said carrier to form a coating the thickness of which increases from the filling side towards the bottom of the cup-shaped charge carrier from a coating thickness of about 25 μm increasing proportionally with the length of the charge carrier to a maximum of about 80 μm.

4. A process as claimed in claim 1, wherein the suspension is applied by a spraying method.

5. A process as claimed in claim 1, wherein the charge carrier is heated until the surface temperature of the dried suspension reaches about 50° C. to 80° C.

* * * * *